United States Patent [19]

Mullins et al.

[11] 4,423,777

[45] Jan. 3, 1984

[54] FLUID PRESSURE ACTUATED WELL TOOL

[75] Inventors: Albert A. Mullins, Humble, Tex.; Clifford H. Beall, Broken Arrow, Okla.

[73] Assignee: Baker International Corporation, Orange, Calif.

[21] Appl. No.: 307,812

[22] Filed: Oct. 2, 1981

[51] Int. Cl.[3] ..... E21B 3/02

[52] U.S. Cl. ..... 166/120; 166/212; 166/217; 92/10

[58] Field of Search ..... 166/121, 120, 122, 212, 166/216, 217, 133, 188, 173, 174, 175; 92/10, 11, 12

[56] References Cited

U.S. PATENT DOCUMENTS

| | | | |
|---|---|---|---|
| 2,137,403 | 11/1938 | Hoferer | 92/10 X |
| 2,275,935 | 5/1942 | Baker | 166/120 |
| 2,546,377 | 3/1951 | Turechek | 166/196 |
| 2,807,326 | 9/1957 | Church | 166/120 |
| 3,136,364 | 6/1964 | Myers | 166/212 X |
| 3,456,723 | 7/1969 | Current et al. | 166/217 X |
| 4,263,968 | 4/1981 | Garner | 166/217 X |

*Primary Examiner*—Ernest R. Purser

*Assistant Examiner*—Michael Starinsky

*Attorney, Agent, or Firm*—Norvell & Associates

[57] ABSTRACT

A packer for a subterranean well has slip elements and elastomeric seal elements which are respectively radially expandable into engagement with a well conduit wherein the packer is mounted in surrounding relationship to an inner sleeve which is rigidly interconnectable to a second conduit. An intermediate sleeve is mounted in axially slidable, concentric relationship to the inner sleeve and cooperates with an outer sleeve to define an annular fluid pressure chamber. A upper piston and a lower piston are mounted in the annular pressure chamber and are driven in opposite directions by application of fluid pressure to such chamber. Compressive forces are thus transmitted to the elastomeric sealing elements and a slip mechanism. The packer also incorporates a hydraulic reservoir which is normally filled with casing fluid and has a constricted orifice connected to the casing annulus. Such reservoir is diminished in volume by any upward movement of the inner sleeve relative to the intermediate sleeve and the flow area of the orifice is proportioned to exert a throttling action on fluid discharge from the reservoir.

26 Claims, 13 Drawing Figures

FLUID PRESSURE ACTUATED WELL TOOL

BACKGROUND OF THE INVENTION

1. Field of the Invention

The invention relates to a fluid pressure actuated tool, such as a packer, for a subterranean well to achieve a sealable anchoring of a conduit to the inner wall of another well conduit.

2. Description of the Prior Art

A large number of fluid pressure actuated packers for subterranean wells have heretofore been disclosed in the prior art. Such packers are generally run into the well on a tubular work string or wire line and have a detachable connection to a fluid pressure operated actuating mechanism carried by the work string or wire line which is withdrawn from the well when the packer is set.

In wells requiring only a single production string, it is desirable to run-in the packer on the production string, set the packer by fluid pressure applied through the production string, and, when necessary, release the packer by manipulation of the production string. Since such production string generally involves a number of vertically spaced packers, it is apparent that the production fluid carrying, inner tubular member of each packer becomes axially fixed, hence no axial movements of such inner tubular member can be relied upon for setting the packer, or subsequently adjusting the compressive force on the elastomeric seal element of the packer to compensate for loss of sealing effectiveness due to extrusion losses of the elastomeric seal material.

Prior art packers have involved an annular elastomeric seal which is capable of being radially expanded into sealing engagement with the casing wall by axially applied compression forces. Such conventional packers generally provided a slip mechanism on some each end of the annular elastomeric seal with the biting teeth of the respective slip mechanisms being reversed in direction, so that one slip mechanism prevents downward movement of the elastomeric seal relative to the casing while the other slip mechanism prevents upward movement of the elastomeric seal relative to the casing. Such packers were conventionally set by first expanding the slip mechanism that prevents downward movement of the seal relative to the casing and then applying an axially downward force to the other slip mechanism to compress the annular elastomeric seal to force the same into sealing engagement with the casing wall and, concurrently, to lock the annular seal in the compressed position by engagement of the teeth of the upper slip with the casing wall to prevent any relative upward movement with respect to the casing wall.

While the compressible annular elastomeric seal may originally achieve a satisfactory seal with the casing wall under the compression forces developed during the initial packing operation, it is well known that such elastomeric materials tend to extrude in an axial direction and thus lose their sealing effectiveness due to the loss of volume of elastomeric material in the sealing zone. There is a need, therefore, for a packer construction which will permit subsequent applications of fluid pressure induced compressive forces to the elastomeric sealing material to overcome the effects of extrusion of such material.

During run-in of prior art packers, the actuating piston or pistons were generally secured by one or more shear pins to maintain the associated slip elements of the packer in their radially retracted position to permit the ready insertion of the packer assemblage into the well. It often happens that the packer mechanism is subjected to impacts as it is lowered into the well, due to hitting an obstruction in the casing string. In some prior art packers, the axial forces generated by such impact were in the direction to effect a shearing of the shear pin or pins that retained the packer assemblage in an inoperative position. Hence, if the impact were sufficiently large, the pins would shear and the packer would be prematurely set. Prior art attempts to eliminate this problem have resulted in complicated mechanisms involving an excessive number of parts.

Another deleterious factor encountered in the operation of some packers is the fact that in the original setting of the packer, an expendable plug is employed to close the fluid passage through the tubing string and the inner tubing of the packer being set, thus permitting a fluid pressure to be developed. Since a particular packer may be supported by several thousand feet of tubing, the effect of such internal pressure is to elastically extend the entire tubing string and the connected inner tubing of the packer. At the close of the packer setting operation, it may be conventional to further increase the internal pressure in the tubing string to cause a release of the expendable plug, and thus the interior of the tubing string and the inner tubing of the packer is subjected to a sudden decrease in internal pressure. This means that the entire tubing string, including the internal tubing of the packer, will elastically relax and thus forcibly move the inner tubing member upwardly. Such forcible movement has been known to effect the severing of the shear pins which are relied upon to prevent relative upward movement of the inner tubing member with respect to the remainder of the packer mechanism, because such upward movement is normally employed to produce an unsetting or release of the packer. There is, therefore, a need for a packer mechanism which adequately absorbs the relaxation movements of the tubing string when the tubing pressure is suddenly released by the opening of the expendable plug.

A packer should be capable of being released or unset by either a right hand turning movement of the tubing string, or the application of a significant upward axial force to the tubing string. Many prior packers provide one or the other of these capabilitites, but not both.

SUMMARY OF THE INVENTION

The packer emodying this invention overcomes all of the aforementioned difficulties encountered in prior art packers. The packer is designed about an inner sleeve member which is appropriately threaded at opposite ends for connection in the production tubing string. If there is no packer to be connected below the particular packer, an expendable plug is secured to the threaded bottom end of the inner tubing. Otherwise, an expendable plug is located at a lower point in the production string. This permits fluid pressure to be increased within the tubing string, hence in the inner sleeve of each packer connected in the string.

A conventional slip assembly, including an annular elastomeric seal, is mounted in surrounding relationship to the inner tubing. In contrast to prior art constructions, no axial movement of the inner sleeve is employed to effect the axial compression of the slip mechanism to effect the setting of the packer. Instead, an intermediate sleeve is mounted in axially sliding relationship around the inner sleeve. The intermediate sleeve cooperates with a concentric outer sleeve to define an annular fluid pressure chamber which is connected through appropriate ports to the bore of the inner sleeve. A pair of annular pistons are disposed in the annular pressure chamber and are respectively movable in opposite axial directions through the application of fluid pressure to the bore of the inner sleeve. The upwardly moving piston is connected to the bottom end of an expandable slip mechanism. The downwardly moving piston is detachably connected to a collet portion provided on the intermediate sleeve and the upper portion of the intermediate sleeve carries an abutment block which applies a downward compressive force to the slip mechanism through the elastomeric seal elements. Thus, the slips are expanded and concurrently, an axial compressive force is applied to an annular elastomeric seal element contained in the slip mechanism to expand such seal element in sealing engagement with the casing wall.

The entire mechanism may be run into the well on the production tubing or on wire line and, during the run-in, one or more shear screws effects the securement of the lower annular piston to the inner sleeve. A second set of shear screws prevents upward movement of the upper annular piston relative to the slip mechanism. Most importantly, an internally projecting shoulder on the outer sleeve is disposed in abutting relationship between an expandable locking ring, mounted in an external groove on the intermediate sleeve, and the uppermost face of the lower piston. An axially extending flange portion on the upper piston is disposed in overlying relationship to the expandable locking ring and thus the entire assemblage is rigidly secured against movement by impacts encountered during the run-in by the fixed engagement of the internally projecting shoulder on the outer sleeve with the aforedescribed expandable locking ring. The slip setting mechanism can then be actuated only when the packer is positioned at the proper depth in the well and internal pressure applied to the bore of the inner sleeve.

The intermediate sleeve is never fixedly secured to the inner sleeve after setting of the packer has been achieved. With the construction of this invention, it is always possible through applying fluid pressure to the bore of the inner sleeve to produce an additional downward movement of the intermediate sleeve and thus provide additional compressive force on the annular elastomeric seal elements to overcome any losses of elastomeric material due to extrusion or cold flow.

Additonally, a packer embodying this invention incorporates an annular fluid reservoir between the lower portions of the lower piston and a recessed portion formed on the exterior of the inner sleeve. Such reservoir is provided with a port communicating with the casing annulus and hence, is normally filled with casing fluid. When the inner sleeve elastically responds by moving upwardly with the tubing string due to the release of the internal fluid pressure required to effect the severance of the expendable plug, the volume of such reservoir is reduced. The size of the port is such that the discharge of fluid through such port is throttled, so that the fluid in the reservoir effectively acts as a hyrdaulic damper and permits only a gradual upward relaxation movement of the tubing string to occur. This eliminates the possibility of accidental shearing of the shear pins which secure the secondary piston to the inner sleeve for limited axial movement, and prevents release of the packer.

Any upward movement of the production string sufficient to effect the shearing of the last mentioned shear pins will also move a recessed portion of the exterior of the inner sleeve adjacent the collet mechanism which connects the intermediate sleeve to the lower piston. This permits the release of the intermediate sleeve from the lower piston and the subsequent relaxation of compressive forces on the slip mechanism and the elastomeric seal, permitting the packer to be moved or retrieved from the well.

As a further safety factor, the packer may be released through the application of a right hand turning movement to the production string, and hence to the inner sleeve of the packer, shearing an anti-rotation shear screw, which will effect a release of the left hand threaded collet portion of the intermediate sleeve from the lower piston and again achieve the release of compressive forces on the slip mechanism and the associated annular elastomeric seal.

BRIEF DESCRIPTION OF THE DRAWINGS

FIG. 1*b* being a continuation of 1*a*, 1*c* a continuation of 1*b*, and 1*d* a continuation of 1*c*.

DESCRIPTION OF THE PREFERRED EMBODIMENTS

Figure 3A:
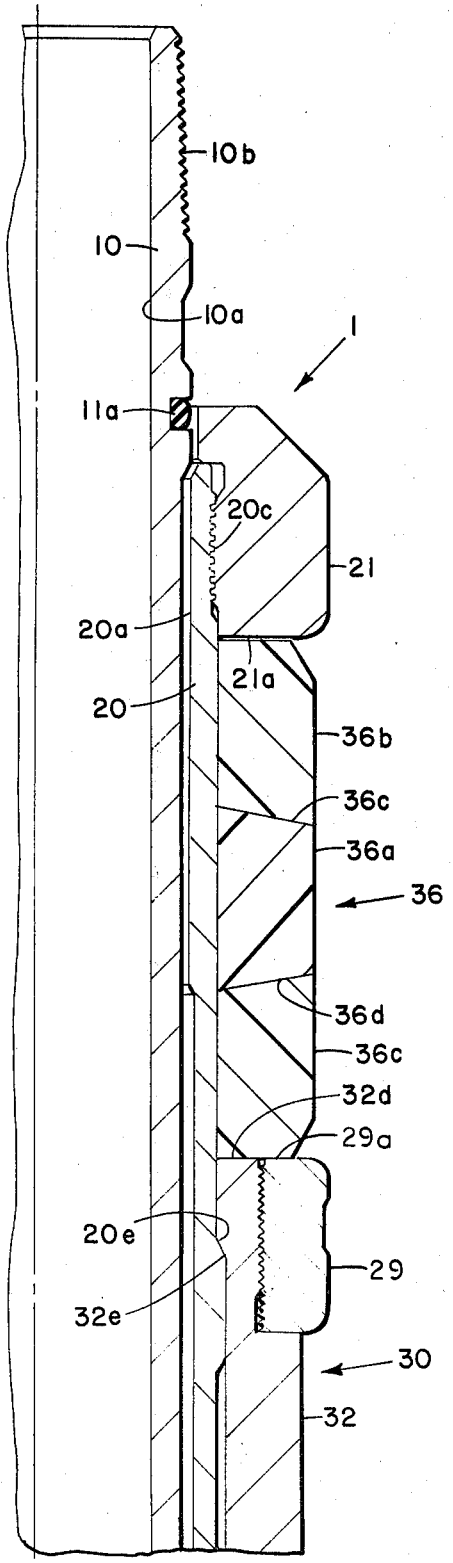
FIGS. 3*a*–3*d* collectively represent the packer assemblage shown in FIGS. 1*a*–1*d* with the elements thereof shown in their packer releasing or retrieval position.
Figure 3B:
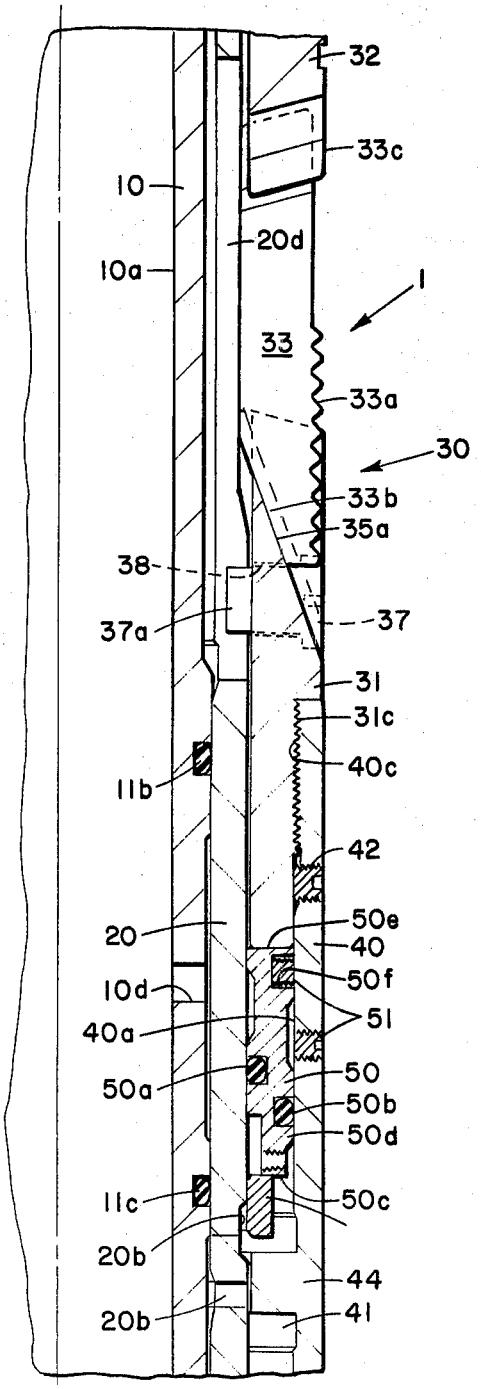
Figure 3C:
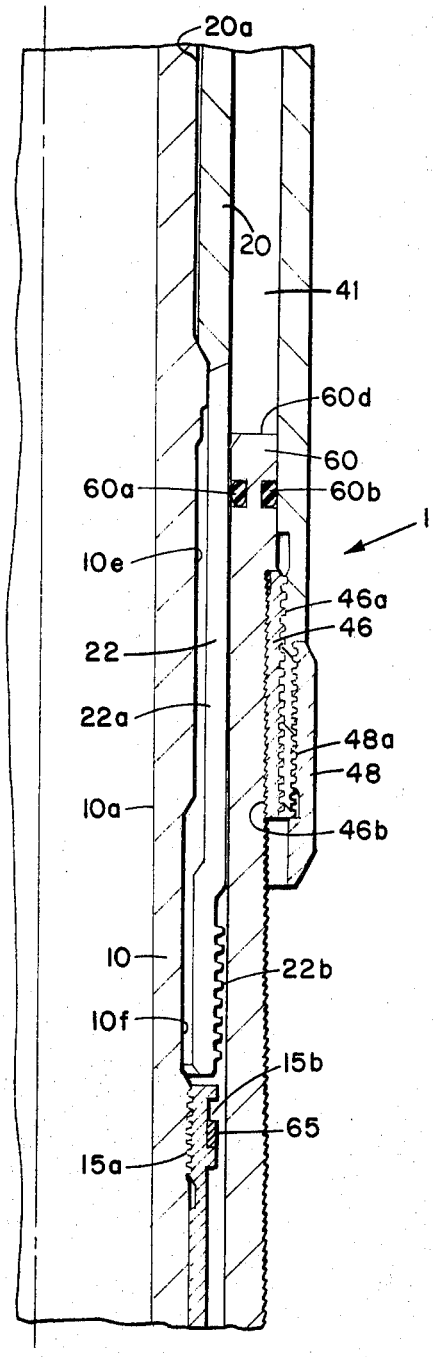
Figure 3D:
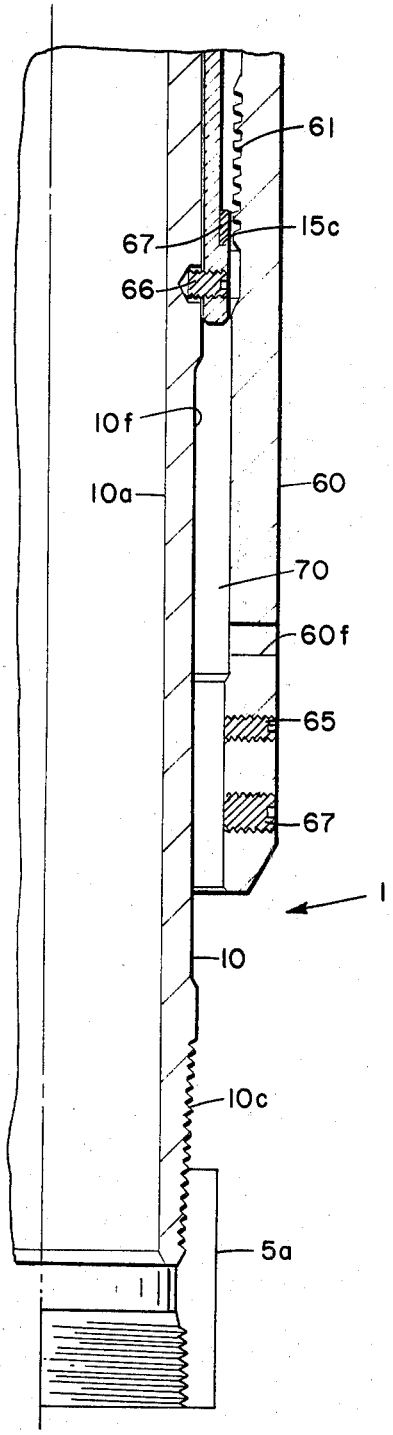

Referring to FIGS. 1*a* through 1*d*, the packer 1 embodying this invention comprises an elongated inner sleeve 10 extending the entire length of the packer and having a bore 10*a*, an upper threaded end 10*b* for securement in a production or work string and a lower threaded end 10*c* for securement in the upper portions of a lowerly extending production or work string or, in the event that no additional equipment is to be mounted below the particular packer, the threaded end 10*c* mounts a conventional expendable plug 5 carried in an internally threaded sleeve 5*a*. Plug 5 is of the type that functions as a valve to open by dropping the plug portion of element 5 to the bottom of the well bore upon an increase in pressure in the bore 10*a* of inner sleeve 10 in excess of that required to effect the setting of the packer 1. This condition is illustrated in FIG. 3*d*.

An intermediate sleeve 20 is mounted in axially sliding relationship to the inner sleeve 10. A fluid seal 11*a* is provided in the upper portions of the wall of inner tube 10 and cooperates with the bore 20*a* of the intermediate sleeve 20 to prevent fluid passage therethrough. At a medial position of the inner sleeve 10, one or more radial ports 10*d* (FIG. 1*c*) are provided which communicate with the annulus defined between the inner sleeve 10 and the intermediate sleeve 20. Axially spaced seals 11*b* and 11*c* are respectively provided above and below the port 10*d* to prevent fluid entering the port from entering the entire annulus defined between the inner sleeve 10 and the intermediate sleeve 20.

Intermediate sleeve 20 is free to move axially relative to the inner sleeve 10 through a limited distance defined by one or more centrifugally spaced, radially disposed shear screws 65 (FIG. 1*d*) which are provided in the bottom portions of a lower piston 60 and cooperate with a limited axial length groove 15*b* in a shear screw retaining sleeve 15 which is threadably secured to the bottom end of the sleeve 10 by threads 15*a*. Further details of this construction will be described hereinafter.

The top end of intermediate sleeve 20 is threadably secured by external threads 20*c* to an annular collar 21 which operates to produce a downwardly directed force on the adjacent elastomeric seal assembly 36 of the slip mechanism 30. The lower end of intermediate sleeve 20 defines a collet portion 22 (FIG. 1*c*) which comprises a plurality of peripherally spaced, axially split radially deflecting member such as collet arms 22*a* having external left hand threads 22*b* formed thereon, which cooperate with internal left hand threads 61 formed on the interior of the lower piston 60. Collet arms 22*a* are inherently spring biased inwardly and are held in their outer position shown in FIG. 1*c* by a radially enlarged wall portion 10*e* of the inner sleeve 10.

Figure 2A:
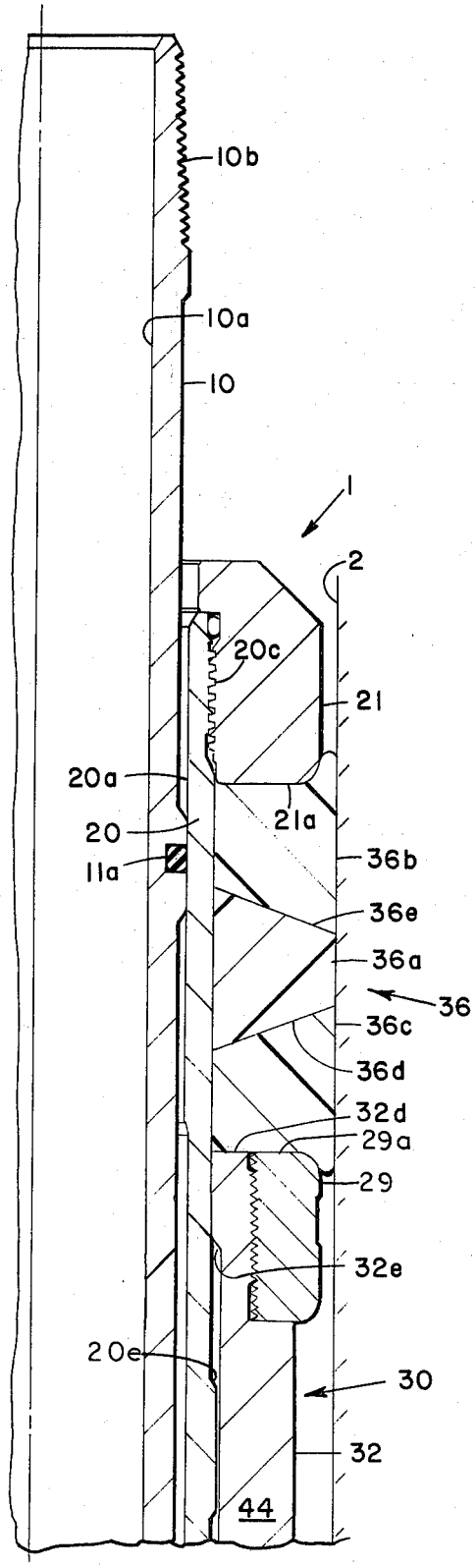
FIGS. 2*a*–2*d* collectively represent the packer assemblage of FIGS. 1*a*–1*d* with the elements of the packer shown in their set position.
Figure 2B:
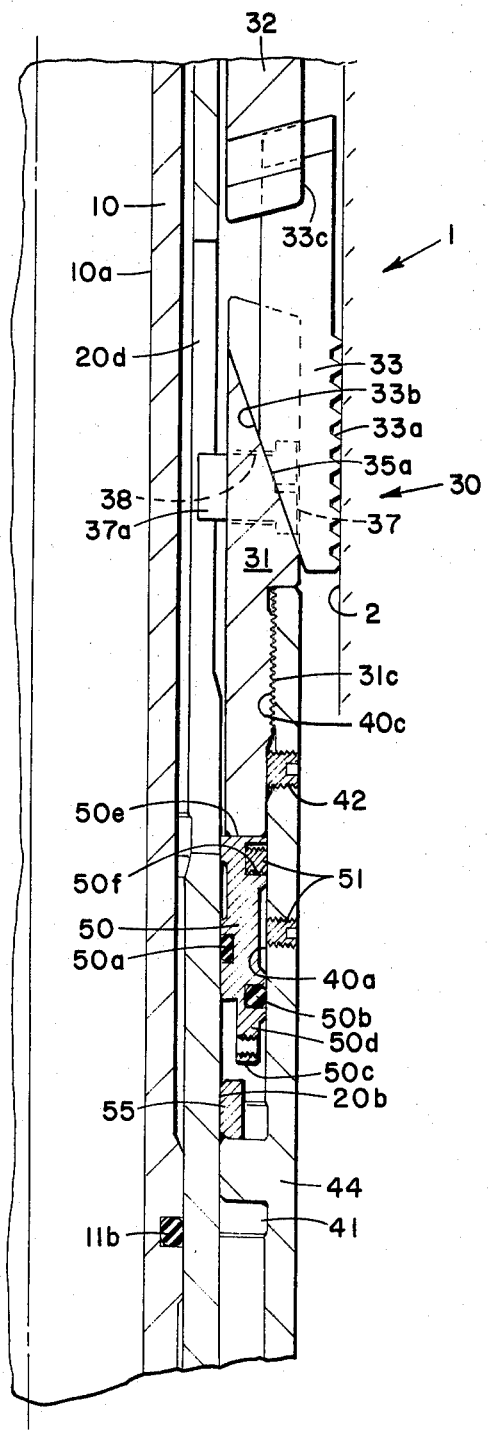

An outer sleeve 40 is provided in radially spaced concentric relationship to the periphery of intermediate sleeve 20 and thus defines therebetween an annular pressure chamber 41 (FIG. 2*b*).

A pair of annular pistons, namely an upper piston 50 and the lower piston 60, are slidably and sealingly mounted in the pressure chamber 41 for axial movements therein under the forces developed by fluid pressure supplied thereto. The upper annular piston 50 is provided with inner and outer O-ring seals 50*a* and 50*b* which respectively cooperate in sealing relationship with the outer peripheral surface of the intermediate sleeve 20 and the inner bore surface 40*a* of the outer sleeve 40. Similarly, O-rings 60*a* and 60*b* are provided in the lower piston 60 to perform a similar function.

Lower piston 60 is employed to impart a downwardly directed force to the intermediate sleeve 20 and thus produce a downwardly directed compression force that is effective on the entire slip mechanism 30, including the elastomeric seal assembly 36.

Figure 1A:
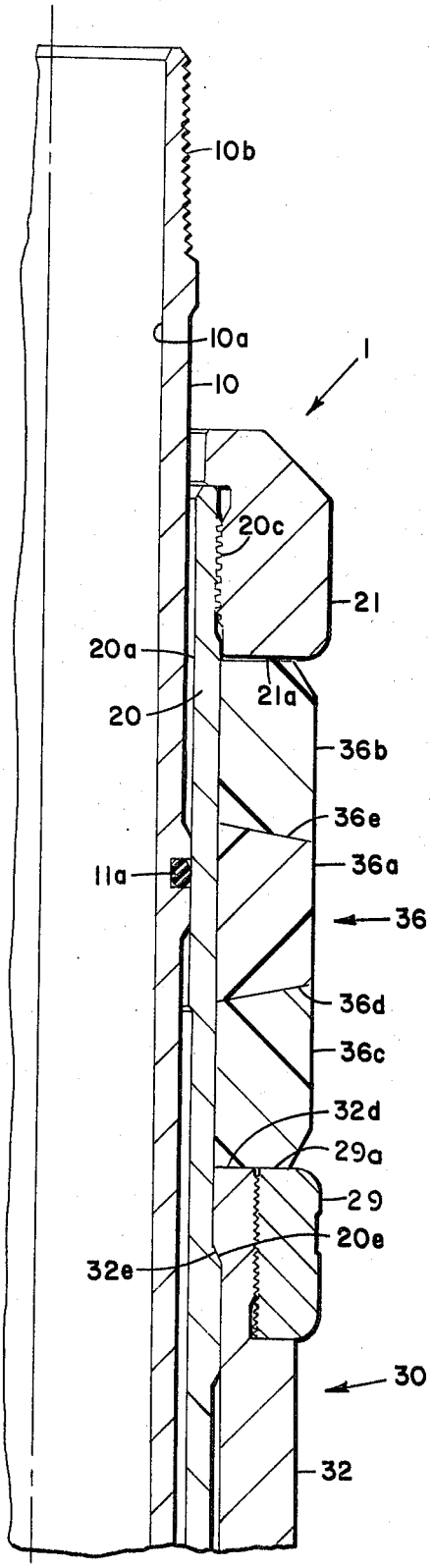
FIGS. 1*a*–1*d* collectively represent vertical quarter sectional views of a packer embodying this invention with the elements thereof shown in their run-in position.
Figure 1B:
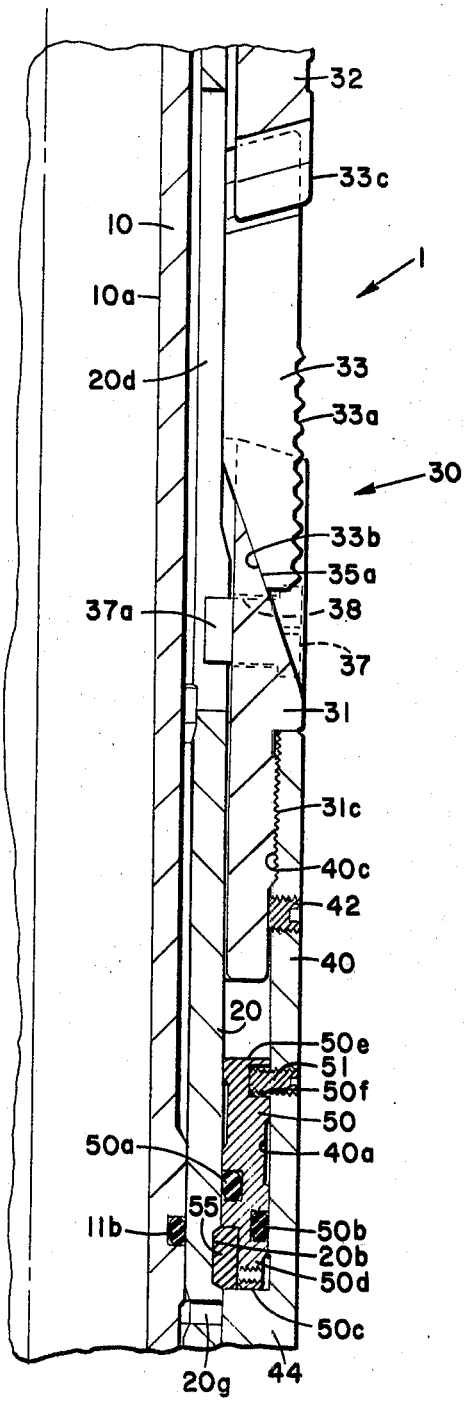
Figure 1C:
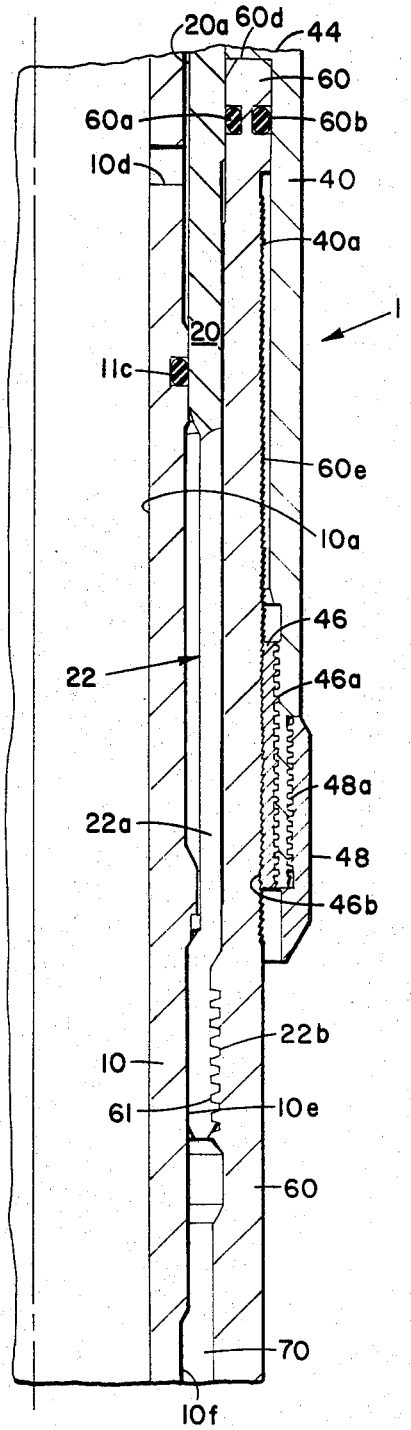
Figure 1D:
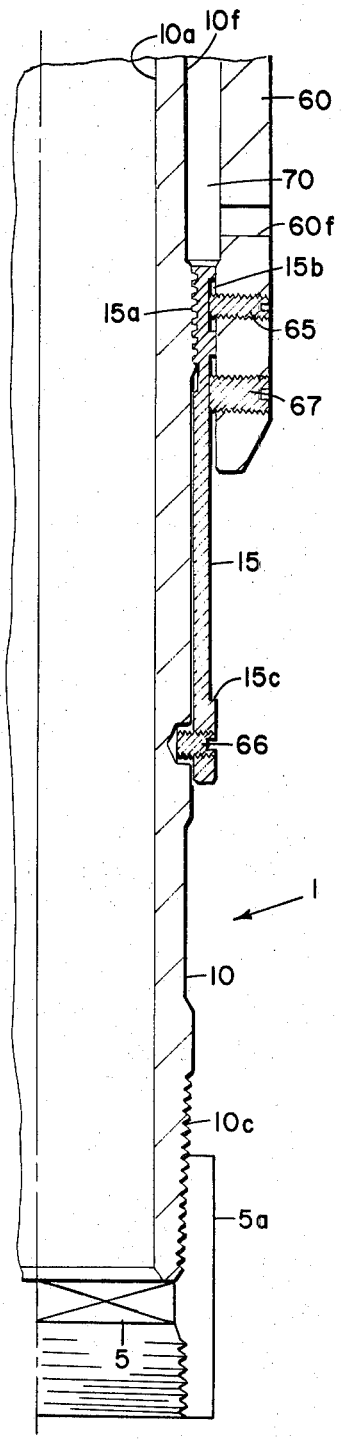

In the run-in position of the packer, as illustrated in FIGS. 1*b* and 1*c*, the bottom surface 50*c* of upper piston 50 is disposed in abutment with an internal shoulder 44 provided on outer sleeve 40. At the same time, the top surface 60*d* of lower piston 60 abuts the downwardly disposed face of shoulder 44. To maintain the two pistons 50 and 60 in this inoperative position during run-in, an expandable locking ring 55 is provided, which is mounted in an appropriate groove 20*b* formed in the outer periphery of the intermediate sleeve 20. Ring 55 is preferably fabricated from an elastic metal and is of C-shaped configuration so that it inherently tends to expand itself out of the groove 20*b*. Inclined shoulders on ring 55 and groove 20*b* facilitate such outward movement.

Locking ring 55 is retained in the groove 20*b* by an axial annular extension 50*d* formed on the bottom end of upper piston 50. Thus, until upper piston 50 is moved upwardly by fluid pressure forces applied thereto, the entire assemblage thusfar described, including the inner sleeve 10, intermediate sleeve 20, outer sleeve 40, and both the upper piston 50 and lower piston 60 is held in an interlocked immobile position irrespective of the fact that the bottom ends of outer sleeve 40 and lower piston 60 may be subjected to jarring impacts during the run-in of the packer assemblage into the well.

Figure 4:
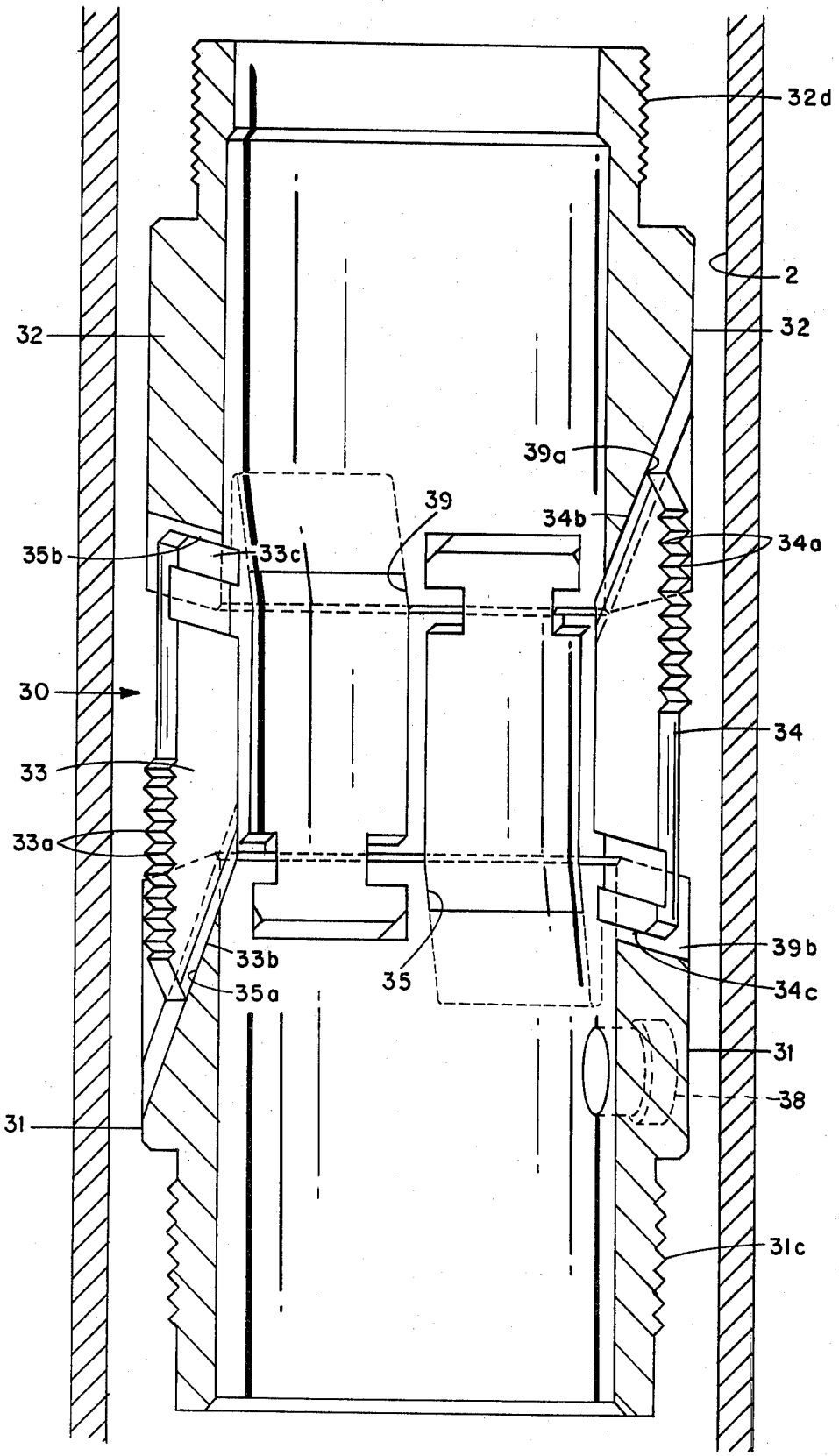
FIG. 4 is an enlarged scale sectional view of the slip mechanism utilized in the packer, with the slip elements retracted.

The upper end of annular upper piston 50 will move into abutting engagement with a lower cone or cam element 31 of the slip mechanism 30. The slip mechanism 30 may comprise any conventional form of mechanism including, if desired, axially spaced slips that are expandable to anchor the mechanism against both upward and downward movement relative to the casing wall and an annular elastomeric seal element therebetween which is compressed and expanded into sealing engagement with the casing wall 2 (FIG. 4), when a compressive force is applied to the slip mechanism. The specifically illustrated construction is that which is described and illustrated in detail in co-pending application Ser. No. 307,972, filed Oct. 10, 1981, and entitled "Slip Assembly For Use In Subterranean Wells", and embodies a slip mechanism 30 wherein both the upwardly resisting and lowerly resisting slip elements are mounted in axially adjacent relationship in a single expanding unit. Thus, the slip mechanism 30 comprises the aforementioned lower cam element 31, and an axially spaced upper cam element 32. Cam element 31 has a slot 35 (FIG. 4) with a gradually inclined bottom surface 35*a* cooperating with a similarly inclined surface 33*b* on each slip element 33 which resists downward displacement of the slip mechanism when engaged with the casing bore. In the preferred embodiment of the invention, at least three of the downwardly facing slip elements 33 are provided in equally spaced relationship around the periphery of the slip mechanism 30, lying in aligned axial slots 35 in lower and upper cam elements 31 and 32. (FIG. 4). The upper end 33*c* of such slip mechanism is formed as an acutely angled T-shaped element which cooperates with a correspondingly shaped T groove 35*b* formed in the upper cam element 32.

An equal number of slip elements 34 are provided intermediate the downwardly effective slip elements 33. Slip elements 34 lie in aligned axial slots 39 provided in cam elements 31 and 32. To actuate these elements, the upper cam element 32 is provided with a gradually inclined camming surface 39*a* which engages a cooperating surface 34*b* on the slip elements 34 and the bottom ends 34*c* of slip elements 34 are of sharply inclined T-shaped configuration and engage in a similarly inclined T-shaped groove 39*b* provided in the lower cam element 31. A key bolt 37 is threadably secured in hole 38 in lower cam element 32 and has a square end 37*a* that cooperates with an axial slot 20*d* provided on the exterior of intermediate sleeve 20 to prevent relative rotation of the cams 31 and 32 and intermediate sleeve 20.

It is therefore apparent that the application of a compressive force to the upper and lower cam or cone elements 31 and 32 will force the slip elements 33 and 34 in an outward direction with teeth 33*a* and facing teeth 34*a* engaging the casing wall 2 (FIG. 2*b*) as the slips are wedged between the cam elements and the casing wall.

The lower annular cam or cone element 31 is provided with external threads 31*c* which are engagable with internal threads 40*c* provided in the top end of the outer sleeve 40. A set screw 42 secures such threads against accidental unthreading. During run-in of the apparatus, one or more radially disposed shear screws 51 are provided in the outer sleeve 40 which respectively cooperate with an annular groove 50*f* provided in upper piston 50 to prevent upward movement of upper piston 50 until sufficient fluid pressure force is applied to the fluid pressure chamber 41 to effect the severing of the shear screws 51. The upper annular piston 50 is then free to move into abutment with the bottom face of the lower cam member 31 of the slip mechanism 30. In this position, the annular piston 50 will resist any downward movement of the lower cam element 31, hence a downward force applied to the slip mechanism 30 by the abutment collar 21 carried by the intermediate sleeve 20 will effect a radially outward expansion of the slip elements 33 and 34 carried by the slip mechanism 30. Concurrently, the annular elastomeric sealing assembly 36 will be compressed to expand radially outwardly into sealing engagement with the wall of the casing as best illustrated in FIG. *2a*.

The annular elastomeric sealing assembly 36 preferably comprises a three element structure respectively constituting a relatively soft annular mass 36*a* surrounded on each axial end by relatively harder elastomeric annular masses 36*b* and 36*c*. The contacting surfaces 36*d* and 36*e* are oppositely tapered in conventional fashion. These elastomeric sealing elements are thus concurrently compressed between the downwardly facing shoulder 21*a* of the annular abutment collar 21 and the end 32*d* of upper cam element 32 and the upwardly facing shoulder 29*a* of an abutment ring 29, which is threadably secured to the upper end of the upper cam or cone element 32.

The diameters of the abutment collars 21 and 29 are only as large as will permit the convenient insertion of the packing apparatus in the casing and hence, when the packer is set and the annular elastomeric seal assembly 36 is compressed to expand outwardly, there will inherently be a tendency of the elastomeric material of the seal elements to cold flow or extrude into the annular spaces defined between the peripheries of the thrust transmitting collars 21 and 29 and the casing wall 2 (FIG. *2a*).

It is apparent that the application of pressured fluid to the annular pressure chamber 41 will concurrently force the upper piston 50 in an upward direction and the lower piston 60 in a downward direction. The initial movement of upper piston 50 will effect the shearing of the run-in shear pins 51 which are provided in the outer sleeve 50 and the upper piston 50 will move into solid abutting engagement with the bottom cam or cone element 31 of the slip mechanism 30. Concurrently, the lower piston 60 is moved downwardly and, due to the collet thread connection 22*b* of such piston with the intermediate sleeve 20, a compressive force is exerted on the slip mechanism 30.

Such compressive force is locked into the slip mechanism 30 by virtue of a ratcheting thread connection provided between the outer surface of the lower piston 60 and the internal surface of a ratcheting sleeve 46, which is secured by threads 46*a* to the bottom end of the outer sleeve 40. Such bottom end of the external sleeve 40 is also externally threaded to receive the internal threads 48*a* of a gage ring 48 which is provided solely as a means for protecting the following slip mechanism from contact with obstructions in the casing bore as the packer mechanism is lowered into the well.

The ratcheting thread connection is defined by inclined external threads 60*e* provided on the outer periphery of the lower piston 60 and similarly inclined internal threads 46*b* provided on the internal surface of the rachet sleeve 46. Such ratcheting threads have the property of freely permitting downward relative movement of the lower piston 60 with respect to the outer sleeve 40, but preventing any upward relative movement. Thus, the compressive forces applied to the elastomeric seal assembly 36 are effectively retained therein, due to the fact that the intermediate sleeve 20 is rigidly locked against motion in a force releasing direction by virtue of the collet thread connection 22*b* of intermediate sleeve 20 to the lower piston 60 and the ratcheting thread connections 60*e* and 46*b* between the lower piston 60 and the outer sleeve 40.

It should, however, be noted that in the event that the elastomeric material of seal assembly 36 should extrude sufficiently to approach a loss in sealing effectiveness, the restoration of a fluid pressure within the bore of the inner sleeve 10 will again effect a downward compressing movement of the intermediate sleeve 20 to further compress the elastomeric seals and restore them to full effectiveness. This action can occur regardless of the fact that the inner sleeve 10 is relatively axially immobile due to its rigid connection to other elements in the production string and slips 33 and 34 are secured to casing wall 2.

The setting of the packer assemblage 1 is indicated by FIGS. *2a–2d*. The actual operation of the various components effecting such setting has already been described.

After the packer 1 is set, it should be noted that the inner sleeve 10 is connected by a plurality of small shear screws 66 in the lower end of shear screw retaining sleeve 15, which, in turn is restrained from rotational movement by large shear screws 67 provided in the bottom end of lower piston 60. Shear screws 67 also limit the extent of axial movement of the lower piston 60 with respect to the inner sleeve 10. As mentioned, shear screw retaining sleeve 15 is threadably secured by threads 15*a* to a lower portion of the inner sleeve 10, adjacent to the bottom end portion of the lower piston 60. The first shearable connection between the shear screw retaining sleeve 15 and the bottom end of the lower piston 60 comprises the shear screw 65 which permits very slight axial travel of the lower piston 60 relative to the inner sleeve 10. Shear screw 65 is thus sheared by the initial downward movement of the lower piston 60 produced during the setting of the packer, as illustrated in FIG. *2d*. The second shearable connection is provided by one or more large shear screws 67 in the bottom end of lower piston 60 to permit a more extended downward axial travel of the lower piston 60 relative to the inner sleeve 10, hence permitting a substantial amount of downward movement for compression of the elastomeric seal assembly 36 by the intermediate sleeve 20. However, when large shear screws 67 are contacted by an upwardly facing shoulder 15*c* provided on the shear screw retaining sleeve 15, the shear screws 67 may be sheared. This generally is accomplished by an upward lifting of the entire production string relative to the set packer.

Such upward movement of the inner sleeve 10 relative to the rest of the packer assemblage moves the radially enlarged portion 10*e* of the inner sleeve 10 from its normal position of engagement with the inner wall of the collet arms 22*a* provided on the end of the intermediate sleeve 20, which holds the threaded outer portions 22*b* of such collet arms in engagement with the left handed threads formed on the interior of the lower piston 60. Such upward movement thus permits a recessed portion 10*f* formed on the periphery of inner sleeve 10 to move into alignment with the collet arms 22*a* to permit such collet arms to swing inwardly, due to their inherent resilience, and to disengage from the left hand internal threads 61 provided on the interior of the lower piston 60. This action concurrently effects a release of compressive forces on the slip mechanism 30 and particularly on the annular seal assemblage 36. Additionally, a radially enlarged portion 20*e* provided on the intermediate sleeve 20 engages a downwardly facing shoulder 32*e* provided on the inner wall of the upper cone or cam element 32, thus forcing such cam elements apart and retracting the slips 33 and 34 from engagement with the casing wall. This results in the components of the packer 1 being moved to the retrieval position specifically illustrated in FIGS. 3*a*–3*d* of the drawing.

As is known to those skilled in the art, it is also desirable that the release of the packer can be accomplished by a right hand rotation of the production or work string on which the packer is assembled. Any rotation of the inner sleeve 10 relative to the remainder of the packer assemblage 1 is normally prevented through the provision of one or more radially disposed shearable small shear screws 66 provided in the end of shear screw retaining sleeve 15. As mentioned, the shear screw retaining sleeve 15 is normally retained against relative rotational movements by the engagement of the large shear screws 67 with the outer periphery of sleeve 15. Thus, the application of a right hand torque to the inner sleeve 10 will effect the shearing of the rotation resisting small shear screws 66, and then produce the concurrent rotation of the threaded collet arm portions 22*a* of the intermediate sleeve 20 to back upwardly out of the left hand internal threads 61 provided in the lower piston 60, thus moving the inner sleeve 10 upwardly relative to the intermediate sleeve 20 to the position shown in FIGS. 3*a*–3*d* wherein the compressive forces are released from the seal assemblage 36 and the slip mechanism 30 in the manner heretofore described. The unthreading motion, of course, produces sufficient axial thrust against the large shear screws 67 to effect their shearing when the upwardly facing shoulder 15*c* contacts such shear screws as a result of the unthreading upward movement of the inner sleeve 10.

After the packer 1 has been initially set in the casing bore, as shown in FIGS. 2*a*–2*d*, it is common practice to blow out the expendable plug or valve 5, which is provided only to temporarily block the bore of the tubing string to permit sufficient pressure to be generated therein to set the packer. When such blow out pressure is applied to the internal bore 10*a* of the inner sleeve 10 and the interconnected production or work string, the entire string tends to elastically elongated. The sudden release of such pressure by the blowing out of the expendable plug 5 produces an elastic snap back in an upward direction of the production string and the connected inner sleeve 10. In some instances, this snap back is sufficiently severe so as to effect the shearing of large shear pins 67 and hence release the compressive forces on the seal and slip elements of the packer.

Figure 2C:
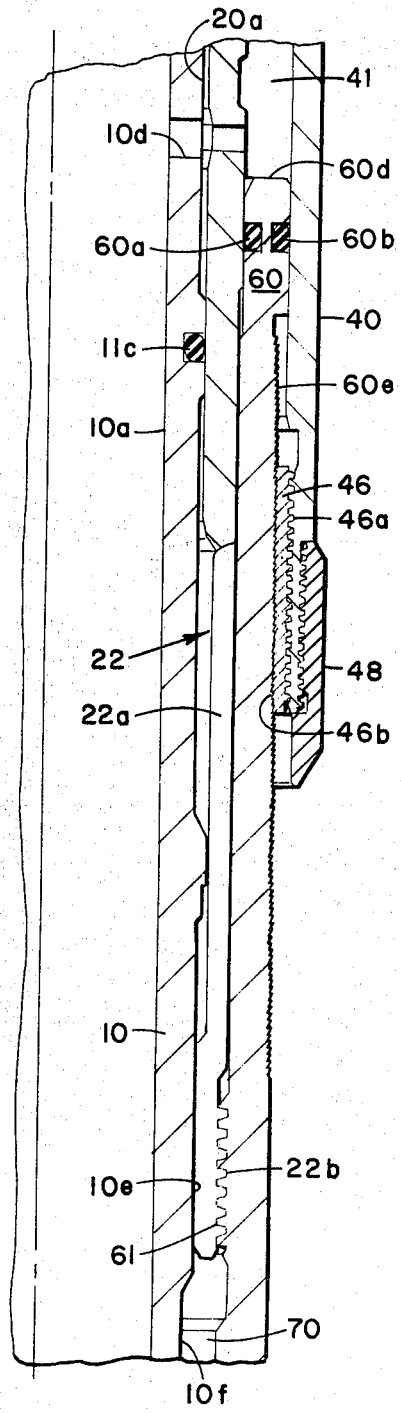
Figure 2D:
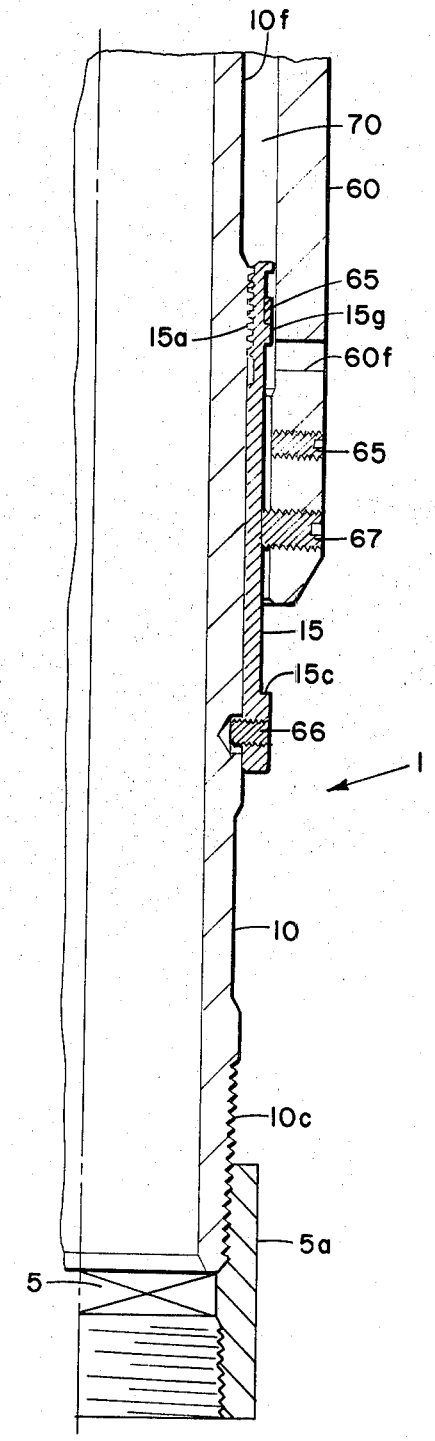

To prevent such occurrence, this invention provides an hydraulic damper which reduces the intensity of the snap back or relaxation movement of the tubing string that occurs upon a sudden release of internal fluid pressure. The recessed external wall portion 10*f* that is provided on the exterior wall of the inner sleeve 10 is utilized to cooperate with the opposed inner face of the lower piston 60 to define a fluid reservoir 70 (FIGS. 2*c* and 2*d*). Thus, the reservoir 70 is filled with annulus fluid during the setting of the packer which can freely flow therein through the port 60*f*. It will be noted that any relative upward movement of the inner sleeve 10 will result in a reduction in volume of the reservoir chamber 70. Accordingly, the diameter of the port 60*f* is selected so as to provide a throttling discharge of fluid from such chamber when it is subjected to a sudden volume reduction due to a snap back upward movement of the inner sleeve 10. Alternately, or in addition to selecting the diameter of port 60*f* to function as a throttling orifice, it will be noted that larger diameter portions of the shear screw retaining sleeve 15 are disposed opposite the port 60*f* when the packer is set. The annular distance between such portions, indicated at 15*g*, (FIG. 2*d*), may be selected so as to provide, in conjunction with the port 60*f*, the desired throttling action on the rapid discharge of fluid from the reservoir 70. In any event, the shearable elements of the packer, that permit it to be released, are protected from any violent impact due to relaxation or snap back movements of the inner sleeve 10 produced by the sudden release of internal fluid pressure in the tubing string.

It was previously mentioned that an O-ring seal 11*a* was provided between the inner sleeve 10 and the upper portions of the intermediate sleeve 20. As is clearly shown in FIG. 3*a*, when the inner sleeve 10 is moved to its packer releasing position, such seal 11*a* moves out of sealing engagement with the intermediate sleeve 20. This permits a fluid flow to be established from the annulus of the well downwardly through the annular flow passage between the inner sleeve 10 and the intermediate sleeve 20, and thence outwardly through the slot 20*d* to again communicate with the casing annulus at a position below the annular elastomeric seal assemblage 36 which may, in some instances, not have completely recovered from their expanded position and hence provide only a limited clearance between their outer surfaces and the casing wall 2. As is well known to those skilled in the art, the ability to establish a downward flow through the casing annulus during the removal of the packer is very desirable particularly when production fluid may still exist in the bore of the inner sleeve 10 and the connected production tubing.

This ability to establish downward flow is especially desirable when kill fluid must be injected through the annulus to control the well after release of the packer seal. In addition to permitting flow through the annular flow passage between the inner sleeve and the intermediate sleeve, the preferred embodiment of this hydraulically actuated packer also prevents recirculation of the kill fluid up through the inner conduit to the surface of the well. This recirculation can occur when the pressure in the tubing above the packer is less than the pressure in the annulus below the packer. Under these conditions the kill fluid will flow through any means of communication between the tubing and the annulus above the packer. Such recirculation can prevent delivery of kill fluid to the formation. In a packer hydraulically acutated by tubing pressure the port exposing the packer's hydraulical actuation mechanism to tubing pressure can provide such unwanted communication. As shown in FIGS. 3*a* and 3*b* the preferred embodiment of the invention prevents kill fluid form being recirculated to the surface. Port 10*d* is sealed by seals 11*b* and 11*c* when movement between inner sleeve 10 and intermediate sleeve 20 disengages seal 11*a* to permit downward flow of kill fluid.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A tool for use in subterranean wells having casing comprising: an inner elongated sleeve connectable to a control element; an intermediate sleeve surrounding said inner sleeve and slidable thereon; an annular slip mechanism surrounding said intermediate sleeve, abutment means on said intermediate sleeve abutting one axial end of said slip mechanism, said slip mechanism being radially expandable by relative axial movement of the other axial end thereof with respect to said intermediate sleeve; an outer sleeve surrounding a medial portion of said intermediate sleeve and defining an annular chamber therebetween; port means in said inner sleeve and said intermediate sleeve for supplying pressured fluid to said annular chamber; one axial end of said outer sleeve being connected to the other end of said slip mechanism, a first annular piston in said annular chamber abutting said other axial end of said slip mechanism for expanding same upon the application of fluid pressure to said annular chamber; a second annular piston in said annular chamber, means for detachable securement of said intermediate sleeve to said second annular piston, thereby applying an axial compressive force to said one end of said slip mechanism; means on the outer wall of said second piston for ratcheting engagement with the inner wall of said outer sleeve, thereby locking said intermediate sleeve and said slip mechanism in a radially expanded, set position engaging the casing wall; and shearable means for securing said inner sleeve in assembly with said second annular piston during run-in of the tool.

2. The tool of claim 1 wherein said slip mechanism includes an annular elastomeric packer seal compressible by the forces developed by said first and second annular pistons to expand radially outwardly to sealingly engage the casing wall.

3. The tool of claim 2 wherein subsequent application of fluid pressure to said annular chamber produces additional axial movement of said intermediate sleeve to further compress said annular elastomeric seal to restore any sealing effectiveness lost by extrusion of the elastomeric material.

4. The tool of claims 1, 2 or 3 further comprising an annular expandable locking element mounted in a groove on the exterior wall of said intermediate sleeve, said first annular piston having a cylindrical wall portion retaining said locking element in said groove; said outer sleeve having an internal shoulder abutting the bottom radial end face of said annular locking element, thereby preventing relative movement between said outer and intermediate sleeves in a slip setting direction.

5. The tool of claims 1, 2 or 3 further comprising an annular expandable locking element mounted in a groove on the exterior wall of said intermediate sleeve, said first annular piston having a cylindrical wall portion retaining said locking element in said groove; said outer sleeve having an internal shoulder positioned in abutting relation between the bottom radial end face of said annular locking element and the top end face of said second annular piston, thereby preventing relative movement of said outer and intermediate sleeves in either direction.

6. The tool of claims 1, 2 or 3 comprising second shearable means for retaining said first annular piston in an axially spaced relation to said slip members by resisting hydraulic forces on said first annular piston during run-in of the tool.

7. The tool of claims 1, 2 or 3 further comprising an annular expandable locking element mounted in a groove on the exterior wall of said intermediate sleeve, said piston having a cylindrical wall portion retaining said locking element in said groove; said outer sleeve having an internal shoulder abutting the bottom radial end face of said annular locking element, thereby preventing relative movement between said outer and intermediate sleeves; said annular locking element comprising an expandable member held in compression by said cylindrical wall portion, whereby application of fluid pressure to said annular chamber moves said first piston toward said slip mechanism to shear said last mentioned shearable means and release said expandable member from said annular groove, thereby permitting said second annular piston to move said intermediate sleeve in the axial direction to compress said slip mechanism.

8. The tool of claim 1 wherein the bottom end portion of said second annular piston and a recessed portion on the exterior wall of said inner sleeve define a fluid reservoir, a discharge port for said reservoir passing through said second annular piston to communicate with the casing annulus, whereby said reservoir is filled with annulus fluid prior to and during the setting operation; said reservoir being constructed so that the relaxation movement of said inner sleeve due to reduction of fluid pressure in said inner sleeve produces a reduction in volume of said fluid reservoir, the fluid passage area of said discharge port being selected to throttle the discharge of fluid from said reservoir and thereby damp the relaxation movement of said inner sleeve.

9. The tool of in claim 1 wherein the bottom end portion of said second annular piston and a recessed portion on the exterior wall of said inner sleeve define a fluid reservoir, a discharge port for said reservoir passing through said second annular piston to communicate with the casing annulus, whereby said reservoir is filled with annulus fluid prior to and during the setting operation; the relative dowward movement of said second annular piston with respect to said inner sleeve moving said discharge port over a larger diameter portion of said inner sleeve to throttle the discharge of fluid from said reservoir produced by relaxation movement of said inner sleeve due to reduction of fluid pressure in said inner sleeve and thereby damp such relaxation movement.

10. The tool of claims 1 or 2 wherein said means for detachable securement of said intermediate sleeve to said second annular piston comprises: internal threads on said annular piston, and resilient radially deflectable member on said intermediate sleeve having externally threaded segments engaging said internal threads.

11. The tool of claims 1 or 2 wherein said means for detachable securement of said intermediate sleeve to said second annular piston comprises: internal threads on said annular piston and an axially split, resilient radially deflectable collet on said intermediate sleeve having externally threaded segments engaging said internal threads.

12. The tool of claims 1 or 2 wherein said means for detachable securement of said intermediate sleeve to said second annular piston comprises: internal threads on said annular piston; and a resilient radially deflectable member on said intermediate sleeve having externally threaded segments engaging said internal threads, said inner sleeve having a radially enlarged surface normally holding said segments in engagement with said internal threads during run-in and setting of the tool; shearable means preventing relative rotation of said inner sleeve and said second annular piston, whereby rotation of the inner sleeve after the tool is set will effect the shearing of said shearable means and the threaded release of said intermediate sleeve from said second annular piston and release the compressive forces on said slip mechanism; and an upwardly facing shoulder on said inner sleeve engagable with said intermediate sleeve by upward movement of the control element to remove the tool.

13. The tool of claims 1 or 2 wherein said means for detachable securement of said intermediate sleeve to said second annular piston comprises: internal threads on said annular piston, a resilient radially deflectable member on said intermediate sleeve having externally threaded segments engaging said internal threads, said inner sleeve having a radially enlarged surface normally holding said segments in engagement with said internal threads during run-in and setting of the tool, said inner sleeve having an annular recessed portion below said radially enlarged surface, shearable means limiting axial upward movement of said inner sleeve relative to said intermediate sleeve whereby an upward force on said inner sleeve will shear said shearable means to permit said annular recessed portion to align with said resilient radially deflectable segments so that said segments may retract from engagement with said internal threads on said second annular piston, thereby releasing the compressive forces on said slip mechanism, and an upwardly facing shoulder on said inner sleeve engagable with said intermediate sleeve by upward movement of the tubing string to remove the tool.

14. The tool of claims 1 or 2 wherein said means for detachable securement of said intermediate sleeve to said second annular piston comprises: internal threads on said annular piston; a resilient radially deflectable member on said intermediate sleeve having externally threaded segments engaging said internal threads, said inner sleeve having a radially enlarged surface normally holding said segments in engagement with said internal threads during run-in and setting of the tool, said inner sleeve having an annular recessed portion below said radially enlarged surface, first shearable means limiting axial upward movement of said inner sleeve relative to said intermediate sleeve, whereby an upward force on said inner sleeve will shear said shearable means to permit said annular recessed portion to align with said radially deflected segments and said segments to retract from engagement with said internal threads on said second annular piston, thereby releasing compressive forces on said slip mechanism, and second shearable means preventing relative rotation of said inner sleeve and said second annular piston, whereby, alternatively, rotation of the inner sleeve after the tool is set will effect the shearing of said second shearable means and the threaded release of said intermediate sleeve from said second annular piston to release compressive forces on said slip mechanism, and an upwardly facing shoulder on said inner sleeve engagable with said intermediate sleeve by upward movement of the tubing string to remove the tool.

15. The tool of claims 1 or 2 wherein said means for detachable securement of said intermediate sleeve to said second annular piston comprises: internal threads on said annular piston, an axially split, resiliently deflectable collet on said intermediate sleeve having externally threaded segments engaging said internal threads, said inner sleeve having a radially enlarged surface normally holding said collet segments in engagement with said internal threads during run-in and setting of the tool, said inner sleeve having an annular recessed portion below said radially enlarged surface, first shearable means limiting axial upward movement of said inner sleeve relative to said intermediate sleeve, whereby an upward force on said inner sleeve will shear said shearable means to permit said annular recessed portion to align with said resiliently deflectable collet segments and said collet segments to retract from engagement with said internal threads on said second annular piston, thereby releasing compressive forces on said slip mechanism, and second shearable means preventing relative rotation of said inner sleeve and said second annular piston, whereby, alternatively, rotation of the inner sleeve after the tool is set will effect the shearing of said second shearable means and the threaded release of said intermediate sleeve from said second annular piston to release compressive forces on said slip mechanism, and an upwardly facing shoulder on said inner sleeve engagable with said intermediate sleeve by upward movement of the tubing string to remove the tool.

16. The tool of claim 2 further comprising fluid sealing means between the inner sleeve and said intermediate sleeve during run-in and setting of the tool, said fluid sealing means being rendered inoperable by relative upward movement of said inner sleeve to a packer releasing position, and a radial port in said intermediate sleeve communicating with the casing annulus below said elastomeric seal.

17. The tool of claim 2 further comprising fluid sealing means on the external surface of said inner sleeve engaging the upper periphery of the inner wall of said intermediate sleeve during run-in and setting of the tool, said means for detachable securement of said intermediate sleeve to said second annular piston being releasable by substantial upward movement of said inner sleeve relative to said intermediate sleeve, thereby moving said fluid sealing means out of engagement with said intermediate sleeve, and a radial port in said upper portion of said intermediate sleeve below said elastomeric seal, thereby permitting annulus fluid flow downwardly around the elastomeric seal.

18. The tool of claims 1 and 2 further comprising means on said inner sleeve for releasing said means for detachable securement of said intermediate sleeve to said second annular piston by relative upward movement of said inner sleeve, thereby releasing the compressive forces on said slip mechanism; an internal shoulder on said inner sleeve thereafter engagable with an external shoulder on said intermediate sleeve by further upward movement of said inner sleeve, and an external shoulder on said intermediate sleeve engagable by said further upward movement with an internal shoulder on said slip mechanism, thereby radially retracting said slip mechanism.

19. The tool of claims 1 or 2 wherein said means for detachable securement of said intermediate sleeve to said second annular piston comprises: internal threads on said annular piston; a resilient radially deflectable member on said intermediate sleeve having externally threaded segments engaging said internal threads, said inner sleeve having a radially enlarged surface normally holding said segments in engagement with said internal threads during run-in and setting of the tool; shearable means preventing relative rotation of said inner sleeve and said second annular piston, whereby rotation of the inner sleeve after the tool is set will effect the shearing of said shearable means and the threaded release of said intermediate sleeve from said second annular piston and release compressive forces on said slip mechanism; an upwardly facing shoulder on said inner sleeve engagable with said intermediate sleeve by upward movement of the control element to remove the tool from position; and an external shoulder on said intermediate sleeve engagable by said upward movement with an internal shoulder on said slip mechanism, thereby radially retracting said slip mechanism.

20. The tool of claims 1 or 2 wherein said means for detachable securement of said intermediate sleeve to said second annular piston comprises internal threads on said annular piston, an axially split, resiliently expandable collet on said intermediate sleeve having externally threaded segments engaging said internal threads, said internal sleeve having a radially enlarged surface normally holding said collet segments in engagement with said internal threads during run-in and setting of the packer, said inner sleeve having an annular recessed portion below said radially enlarged surface, shearable means limiting axial upward movement of said inner sleeve relative to said intermediate sleeve, whereby an upward force on said inner sleeve will shear said shearable means to permit said annular recessed portion to align with said resiliently expanded collet segments so that said collet segments may retract from engagement with said internal threads on said second annular piston, thereby the releasing compressive forces on said slip mechanism, and an upwardly facing shoulder on said inner sleeve engagable with said intermediate sleeve by further upward movement of the control element to remove the tool, and an external shoulder on said intermediate sleeve engagable by said further upward movement with an internal shoulder on said slip mechanism, thereby radially retracting said slip mechanism.

21. In a fluid pressure set packer for use in a subterranean well having casing, said packer having an inner sleeve connectible to a control element, a radially expandable slip mechanism surrounding said inner sleeve and actuated by an annular piston responsive to fluid pressure in said inner sleeve to move to a set position, plug means for blocking fluid flow through said inner sleeve to permit a substantial increase in fluid pressure in the tubing string and said inner sleeve, the improvement comprising: an axial extension on the annular piston cooperating with said inner sleeve to define an annular fluid reservoir having a port communicating with the casing annulus, thereby filling said reservoir with annulus fluid, said reservoir being constructed and arranged to decrease in volume when fluid pressure is released from said tubing string and inner sleeve, permitting axial resilient relaxation of the control element and inner sleeve, the fluid passsage area of said discharge port being selected to throttle the discharge of fluid from said reservoir and thereby damp the relaxation movement of said inner sleeve.

22. The improvement defined in claim 21 wherein said reservoir is defined in part by a recess formed on the exterior of said inner sleeve and said port is located to move axially during setting of the slip mechanism from a position in alignment with said recessed portion to a position in alignment with a small annulus between said annular piston and said sleeve, thereby constricting discharge flow through said port.

23. A method of killing a subterranean oil or gas well upon release of a well tool hydraulically actuated by fluid pressure in an inner conduit communicating with the tool and having an annular seal for establishing sealing integrity between the inner conduit and the casing of the well, comprising the steps of: injecting kill fluid into the annulus between the inner conduit and the casing above the tool: opening an annular flow passage between the inner conduit and the annular seal to permit communication between the annulus above the tool and a radial slot in the tool below the annular seal to establish communication between the annulus above and below the tool; and sealing the means of communication between the inner conduit and the hydraulically actuated tool to prevent kill fluid in the annulus from entering the inner conduit and being recirculated to the surface of the well.

24. The method of claim 23 wherein said annular flow passage is opened and said means of communication between the inner conduit is sealed by relative longitudinal movement of an inner sleeve on said tool attached to the inner conduit and a concentric intermediate sleeve.

25. A tool mounted on an inner conduit within an exterior conduit or casing in a subterranean well with an annular area separating said inner and said exterior conduits, said tool comprising: a radially expandable annular slip mechanism for engaging said casing and a radially expandable annular seal for establishing sealing integrity with said casing; hydraulic actuating means for applying an axially compressive force to radially expand said annular slip mechanism and said annular seal; an inner sleeve; a first radial port through said inner sleeve for providing communication between said hydraulic actuating means and the interior of said inner conduit; an intermediate sleeve between said inner sleeve and said annular slip mechanism; means for radially contracting said annular slip mechanism upon relative movement between said inner sleeve and said intermediate sleeve; the improvement comprising: a second radial port in said intermediate sleeve below said annular seal; first seal means between said inner sleeve and said intermediate sleeve for initially preventing fluid communication between said annular area and said second radial port, said first seal means being disengageable upon relative movement of said inner sleeve and said intermediate sleeve to expose said second radial port to fluid in said annular area; second seal means between said inner sleeve and said intermediate sleeve for preventing fluid communication between said hydraulic actuating means and said second radial port; and third sealing means for preventing fluid communication between said annular area and the interior of said inner conduit through said first radial port after disengagement of said first sealing means, whereby upon radial contraction of said annular slip mechanism fluid in the annular area above said annular seal may be circulated past said first sealing means, between said inner sleeve and said intermediate sleeve, through said second radial port and into the annular area below said annular seal without recirculation to the surface through said first radial port and through said inner conduit.

26. In a fluid pressure set packer for use in a subterranean well having casing, said packer having an inner sleeve connectable to a control element, a radially expansible slip mechanism surrounding said inner sleeve and actuated by a pair of oppositely moving annular pistons responsive to fluid pressure in said inner sleeve to move to a set position; plug means for blocking fluid flow through said inner sleeve to permit a substantial increase in fluid pressure in the tubing string and said inner sleeve; the improvement comprising: an axial extension on one of said annular pistons cooperating with said inner sleeve to define an annular fluid reservoir having a port communication with the casing annulus, thereby filling said reservoir with annulus fluid, said reservoir being constructed and arranged to decrease in volume when fluid pressure is released from said tubing string and inner sleeve, permitting axial resilient relaxation of the control element and inner sleeve, the fluid passage area of said discharge port being selected to throttle the discharge of fluid from said reservoir and thereby damp the relaxation movement of said inner sleeve.

* * * * *